US007337614B2

(12) United States Patent
Cowan

(10) Patent No.: US 7,337,614 B2
(45) Date of Patent: Mar. 4, 2008

(54) ENGINE FUELING METHOD

(75) Inventor: Curtis C. Cowan, East Hampton, CT (US)

(73) Assignee: United Technologies Corporation, Hartford, CT (US)

( * ) Notice: Subject to any disclaimer, the term of this patent is extended or adjusted under 35 U.S.C. 154(b) by 192 days.

(21) Appl. No.: 11/184,264

(22) Filed: Jul. 18, 2005

(65) Prior Publication Data

US 2006/0283192 A1 Dec. 21, 2006

Related U.S. Application Data

(62) Division of application No. 10/691,791, filed on Oct. 23, 2003, now Pat. No. 6,935,117.

(51) Int. Cl.
*F02C 7/08* (2006.01)
*F02C 7/22* (2006.01)
*F23D 11/44* (2006.01)

(52) U.S. Cl. ..... 60/776; 60/39.281; 60/736; 431/11; 431/207

(58) Field of Classification Search ..... 60/39.281, 60/39.463, 776, 736; 431/11, 207, 208, 231, 431/278, 284, 285
See application file for complete search history.

(56) References Cited

U.S. PATENT DOCUMENTS 5,584,171 A * 12/1996 Sato et al. ..... 60/773
6,105,370 A * 8/2000 Weber ..... 60/733

* cited by examiner

*Primary Examiner*—Charles G Freay
(74) *Attorney, Agent, or Firm*—Bachman & LaPointe, P.C

(57) ABSTRACT

A gas turbine engine is piloted with a pilot flow of fuel delivered to a combustor as a liquid. A first additional flow of the fuel is also delivered to the combustor as a liquid. A second additional flow of the fuel is vaporized and delivered to the combustor as a vapor. A fuel injector may have passageways associated with each of the three flows.

21 Claims, 5 Drawing Sheets

ENGINE FUELING METHOD

CROSS-REFERENCE TO RELATED APPLICATION

This is a divisional application of Ser. No. 10/691,791, filed Oct. 23, 2003 now U.S. Pat. No. 6,935,117, and entitled TURBINE ENGINE FUEL INJECTOR.

U.S. GOVERNMENT RIGHTS

The invention was made with U.S. Government support under contract F33615-95-C-2503 awarded by the United States Air Force. The U.S. Government has certain rights in the invention.

BACKGROUND OF THE INVENTION

The invention relates to gas turbine engine combustion. More particularly, the invention relates to fuel injection systems for aircraft gas turbine engines.

Common gas turbine engines are liquid fueled. In a typical arrangement, the engine's combustor has one or more fuel injectors, each of which has a main passageway with multiple outlets for introducing a main flow of fuel and a pilot passageway for introducing a pilot flow of fuel. The pilot flow is initiated to start the engine and may remain on throughout the engine's operating envelope. The main flow may be initialized only above idle conditions and may be modulated to control the engine's output (e.g., thrust for an aircraft). For variety of performance reasons, it is known to use gaseous fuel (including a vaporized liquid). It is also known to use fuel as a heatsink.

SUMMARY OF THE INVENTION

Accordingly, one aspect of the invention involves a method for fueling a an engine associated with a source of fuel in liquid form. The engine is piloted with a pilot flow of the fuel delivered to a combustor as a liquid. A first additional flow of the fuel is also delivered to the combustor as a liquid. A portion of the fuel is vaporized and delivered as a second additional flow of the fuel to the combustor as a vapor.

In various implementations, in at least certain conditions the first and second additional flows may be simultaneous. A mass flow of the second additional flow may be 40-70% of a total main burner fuel flow. The vaporizing may comprise drawing heat to the portion from at least one system on or associated with the engine. A ratio of the first flow to the second flow may be dynamically balanced based upon a combination desired heat extraction from the at least one system and a desired total fuel flow for the engine. The engine may be a gas turbine engine.

The fuel may be delivered through a fuel injector. The injector may include a mounting flange, a stem extending from a proximal portion at the mounting flange to a distal portion, and a nozzle proximate the stem distal portion. A first passageway may extend through the stem from a first inlet to a first outlet at the nozzle. The first outlet may have a number of apertures. A second passageway may extend through the stem from a second inlet to a second outlet at the nozzle. The second outlet may comprise a number of apertures, generally inboard of the apertures of the first passageway. A third passageway may extend through the stem from a third inlet to a third outlet at the nozzle. The third outlet may have at least one aperture generally inboard of the apertures of the first passageway.

The first passageway may have an affective cross-sectional area larger than an affective cross-sectional area of the second passageway. The affective cross-sectional area of the first passageway may be larger than an affective cross-sectional area of the third passageway. Along major portions of respective lengths, the first, second, and third passageways may be within respective first, second, and third conduits. The first passageway may include an outlet plenum.

Another aspect of the invention involves a combustor system for a gas turbine engine. A combustion chamber has at least one air inlet for receiving air. There is at least a first source of a gaseous first fuel and at least a second source of an essentially liquid second fuel. At least one fuel injector is positioned to introduce the first and second fuels to the air. In various implementations, the first and second sources may comprise portions of a fuel system having a liquid fuel supply common to the first and second sources, with the second source vaporizing the liquid fuel to form the first fuel. The injectors may have a pilot passageway for carrying a pilot portion of the second fuel, a main liquid passageway for carrying a second portion of the second fuel, and a gaseous fuel passageway for carrying the first fuel.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
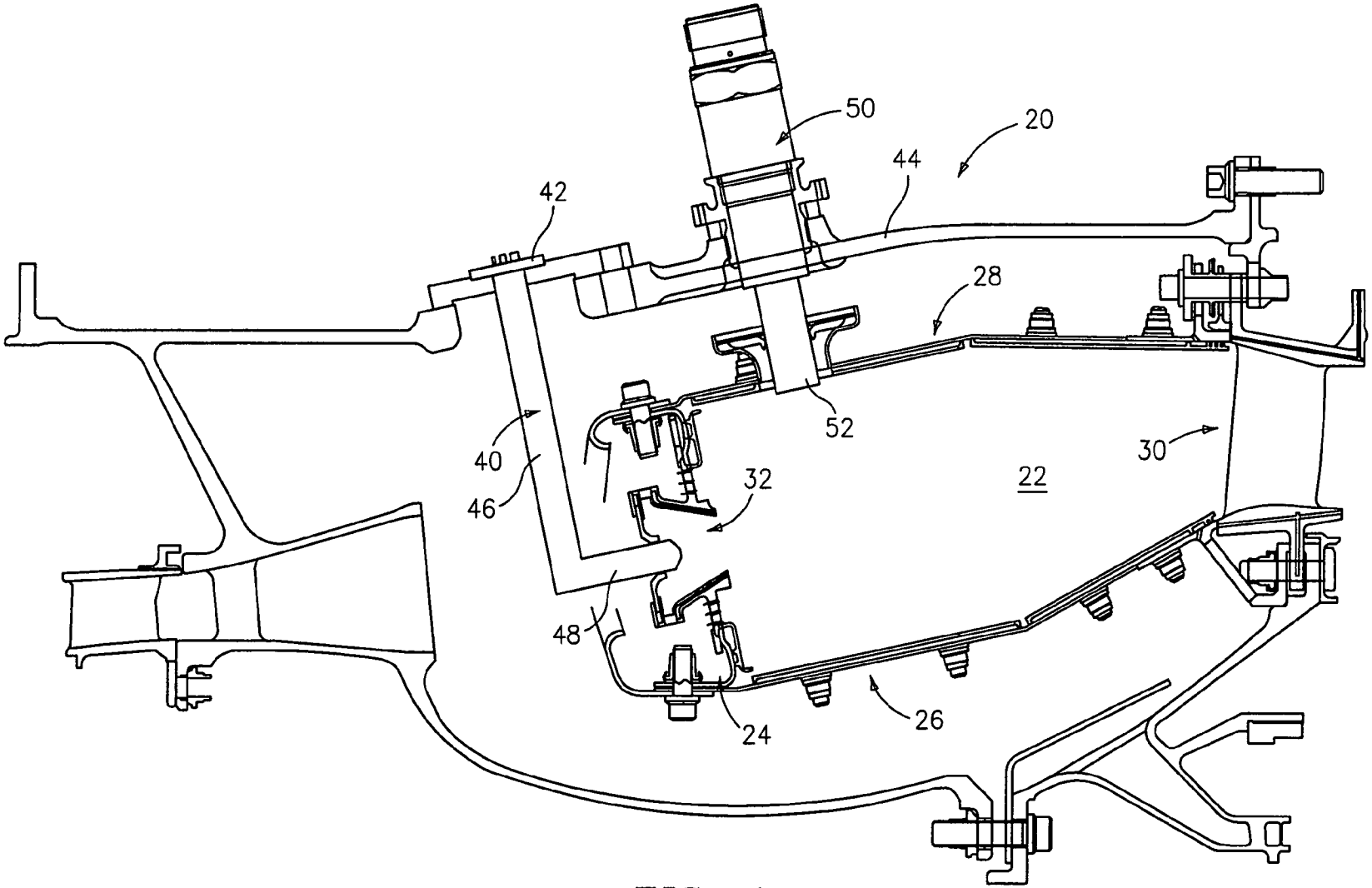
FIG. 1 is a partial longitudinal sectional view of a gas turbine engine combustor.

FIG. 1 shows a turbine engine combustor section 20 having a combustion chamber 22. The chamber has an upstream bulkhead 24 and inboard and outboard walls 26 and 28 extending aft from the bulkhead to an outlet 30 ahead of the turbine section (not shown). The bulkhead and walls 26 and 28 may be of double layer construction with an outer shell and an inner panel array. The bulkhead contains one or more swirlers 32 which provide an upstream air inlet to the combustion chamber. A fuel injector 40 may be associated with each swirler 32. The exemplary fuel injector 40 has an outboard flange 42 secured to the engine case 44. A leg 46 extends inward from the flange and terminates in a foot 48 extending into the associated swirler and having outlets for introducing fuel to air flowing through the swirler. One or more igniters 50 are mounted in the case and have tip portions 52 extending into the combustion chamber for igniting the fuel/air mixture emitted from the swirlers.

Figure 2:
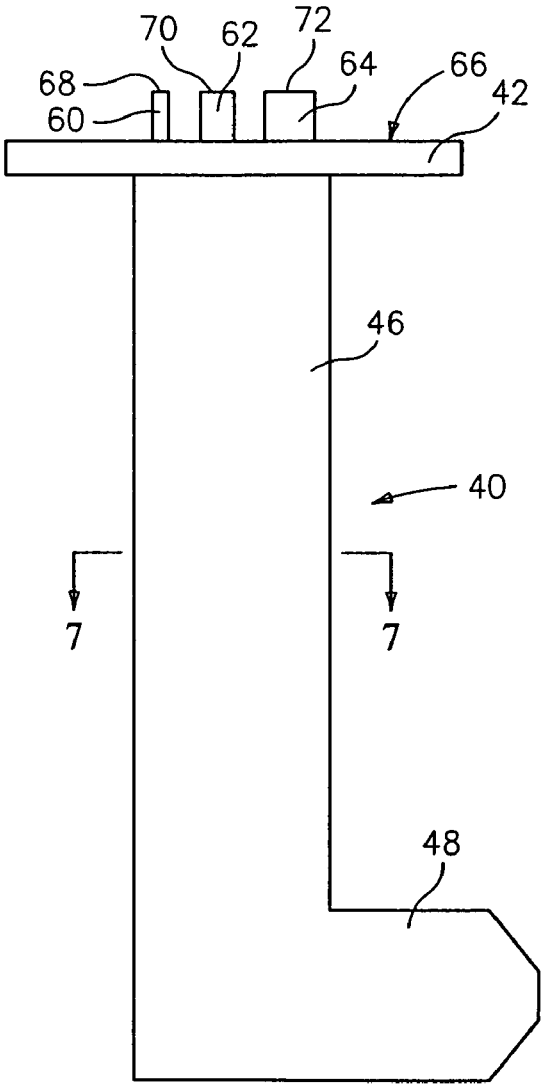
FIG. 2 is a side view of a fuel injector of the engine of FIG. 1.
Figure 3:
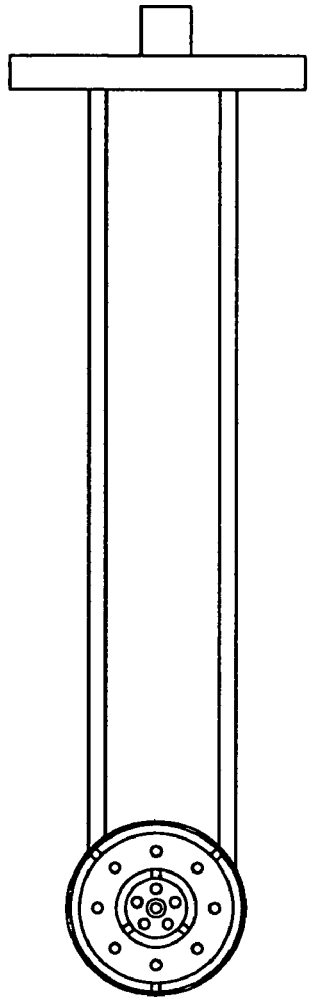
FIG. 3 is an aft view of the fuel injector of FIG. 2.
Figure 4:
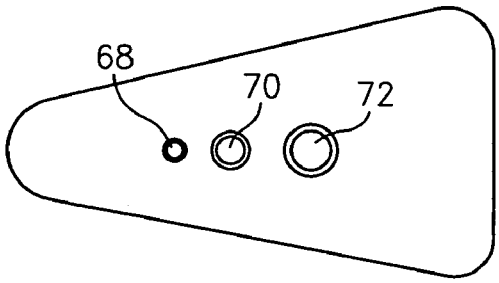
FIG. 4 is an inward view of the fuel injector of FIG. 2.
Figure 5:
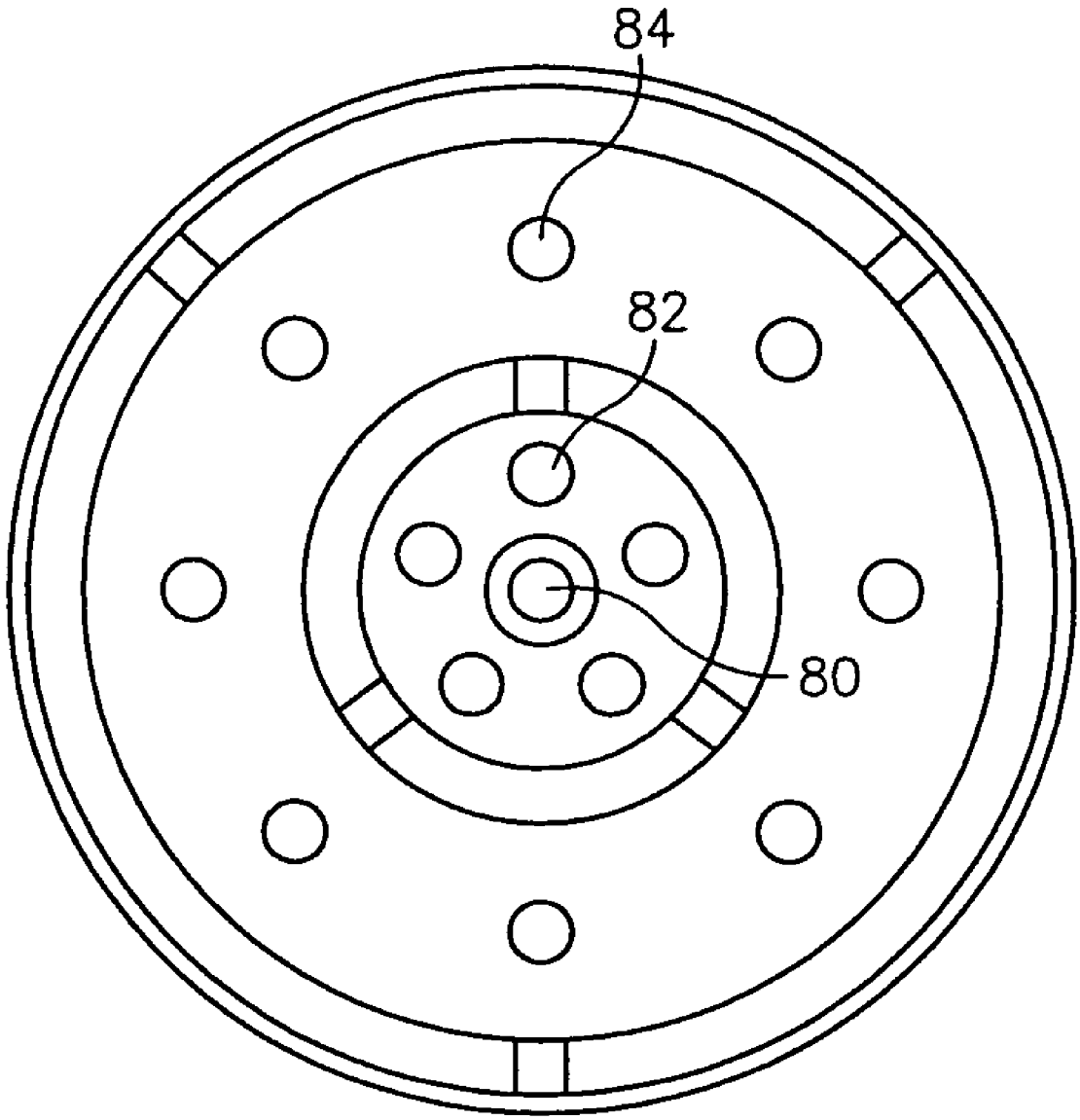
FIG. 5 is an end view of an outlet of the fuel injector of FIG. 2.

The exemplary fuel injector 40 (FIG. 2) has three conduits 60, 62, and 64 defining associated passageways through the injector. In the exemplary embodiment, an upstream portion of each conduit protrudes from the outboard surface 66 of the flange 42 and has an associated inlet 68, 70, and 72.The first passageway (through the first conduit 60) is a pilot passageway and terminates at an outlet aperture 80 (FIG. 5). The second passageway (through the second conduit 62) is a main liquid fuel passageway and terminates in a circular array of outlet apertures 82 outboard of the pilot aperture 80. The third passageway (through the third conduit 64) is a gaseous fuel passageway and terminates in a circular array of outlet apertures 84 outboard of the apertures 82.

Figure 6:
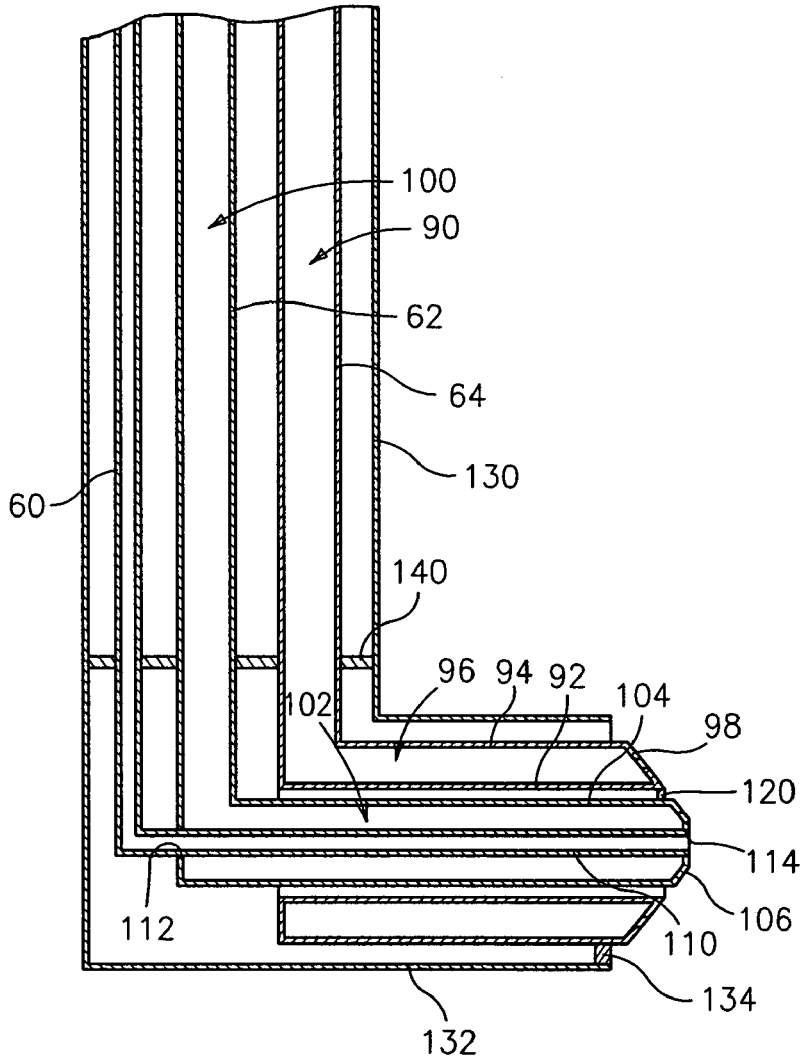
FIG. 6 is a partial longitudinal sectional view of the injector of FIG. 2.

FIG. 6 shows further details of the passageways. The gaseous fuel passageway has a leg portion 90 within the injector leg where the associated conduit 64 is essentially tubular. Along the injector foot, the conduit becomes an annular form having inner and outer walls 92 and 94 defining a plenum portion 96 of the gaseous fuel passageway therebetween. The walls 92 and 94 meet at an angled end wall 98 in which the associated outlet apertures 84 are formed. The main liquid fuel passageway is somewhat similarly formed with a leg portion 100 and a plenum portion 102. The plenum is laterally bounded by an outer wall 104 and at the downstream end by an end wall 106 in which the associated outlet apertures 82 are formed. In the exemplary embodiment, the inner wall of the plenum is formed by a foot portion 110 of the first conduit 60.

Along the injector foot, the foot portion 110 of the first conduit 60 passes through an aperture 112 in the second conduit 62 near the intersection of the leg and plenum portions of the second passageway. There the first conduit is secured to the second conduit such as by brazing. Similarly, an end portion of the first conduit 60 may be secured within an aperture 114 in the end plate 106. This securing is appropriate as there is relatively little stress between the first and second conduits when both are carrying liquid fuel. However, the inner wall 92 of the foot portion of the third conduit is held spaced-apart from the outer wall 104 of the foot portion of the second conduit by spacers 120. Advantageously, the spacers may float with respect to one of these two conduits and be secured to the other. This permits relatively free floating differential thermal expansion of the third conduit relative to the second and first as the former may be more highly heated by the gaseous fuel it carries.

Figure 7:
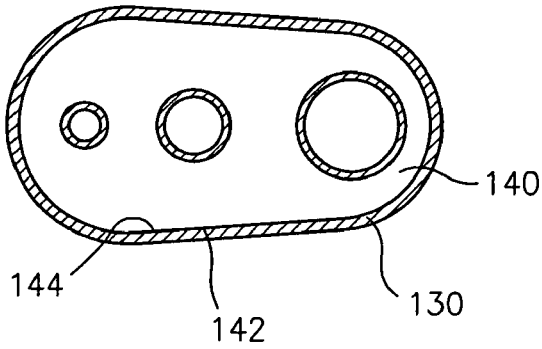
FIG. 7 is a sectional view of the injector of FIG. 2 taken along line 7-7.

Externally, the injector includes a heat shield having leg and foot portions 130 and 132. As with the second and third conduit foot portions, the third conduit foot portion and heat shield foot portion are held spaced apart by spacers 134 which may be secured to one of the two so as to permit differential thermal expansion. Within the leg, there may be several collar plates 140 having three apertures for accommodating the leg portions of the three conduits and an outer periphery 142 (FIG. 7) in close facing proximity to the interior surface 144 of the heat shield leg portion. In the exemplary embodiment, the first and second apertures very closely accommodate the leg portions of the first and second conduits and the collar plates are secured about such apertures to the first and second conduits such as by brazing. The third aperture more loosely accommodates the leg portion of the third conduit so as to permit thermal expansion of the third conduit within the third aperture when gaseous fuel passes therethrough.

Figure 8:
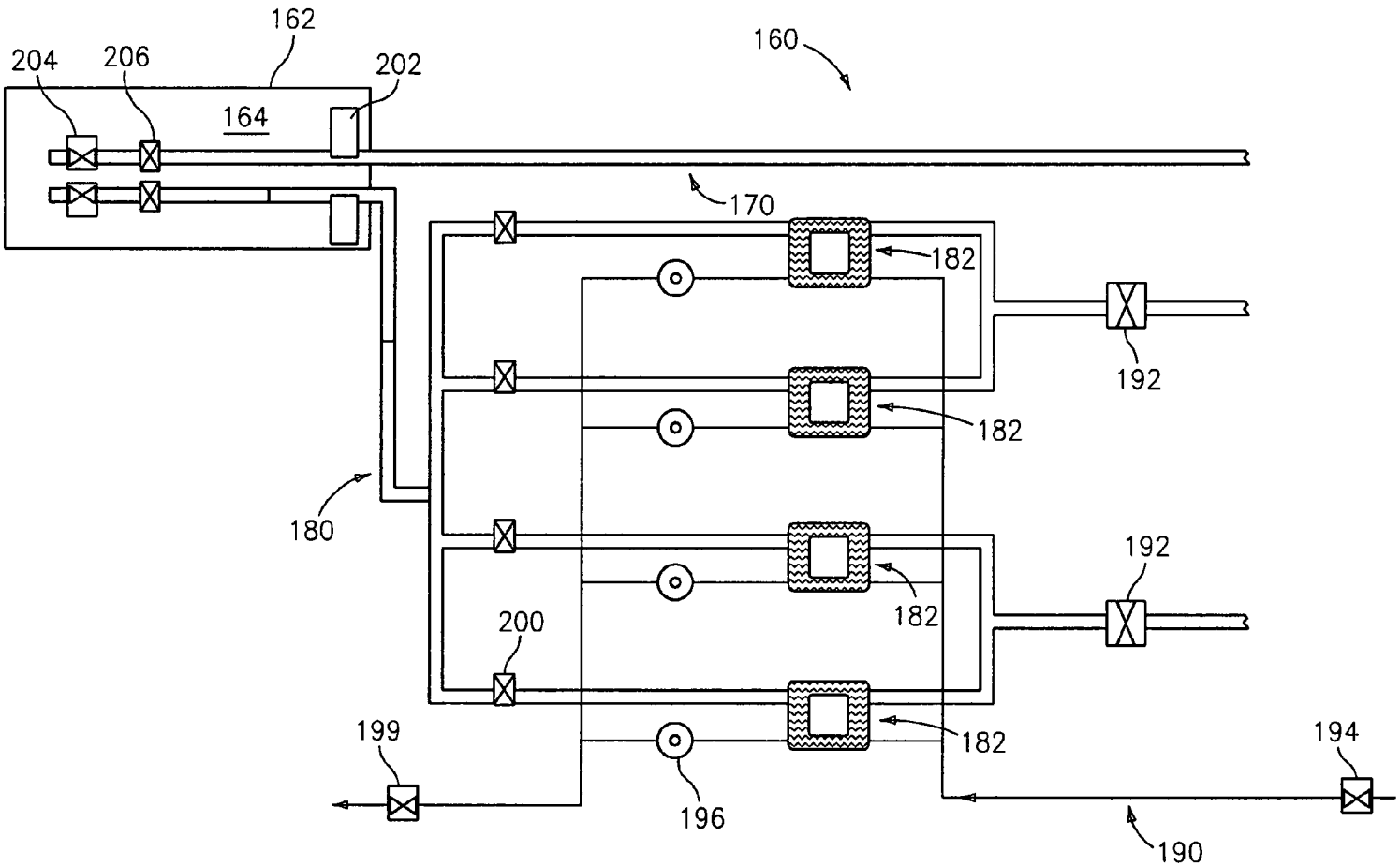
FIG. 8 is a schematic view of a fuel delivery system.

FIG. 8 shows an exemplary fuel supply system 160 including an exemplary reservoir 162 of fuel 164 stored as a liquid. There are one or more first fuel flow paths 170 from the reservoir for delivering for delivering fuel as a liquid to the fuel injectors. In an exemplary embodiment, the first fuel flowpaths for each injector bifurcate in or near the injector so that one branch feeds the pilot conduit 60 and the other branch feeds the liquid conduit 62. The liquid conduit 62 may be sealed by a valve (not shown) in or near the fuel injector. The valve may be normally closed, opening only when there is sufficient liquid fuel pressure. In such an implementation, the pilot conduits are always carrying fuel whenever there is liquid fuel flow and the main liquid conduits open only when the fuel flow exceeds a maximum pilot level.

Additionally, there are one or more flow paths 180 for delivering fuel as a gas. The gas and liquid flow paths may partially overlap and, within either family, the flow paths may partially overlap. The gaseous flow paths include heat exchangers 182 for transferring heat to liquid fuel along such gaseous flow paths to vaporize such fuel. In the exemplary embodiment, the heat exchangers are fluid-to-fluid heat exchanges for drawing heat from one or more heat donor fluids flowing along one or more fluid flow paths 190. Exemplary heat donor fluid is air from the high pressure compressor exit. Gaseous fuel delivery is governed by one or more pressure regulating valves 192 downstream of the heat exchangers. Control valves 194 in the donor flow paths may provide control over the amount of flow through such donor flow paths. FIG. 8 also shows exemplary orifice plates 196 in the donor flow paths governing passage therethrough. The plates serve to meter the flow along the donor flowpaths. FIG. 8 further shows flow meters 200, filters 202, and control valves 204 at various locations along the fuel flow paths.

In operation, the desired engine output will essentially determine the desired total amount of fuel. The desired heat extraction from the donor flow path 190 will essentially determine the amount of such fuel which passes along the gaseous flow paths 180. Although the temperatures of the liquid fuel in the reservoir and of the discharge vapor may vary, the latent heat of vaporization strongly ties the mass flow rate of vaporized fuel to the desired heat extraction. In operation, therefore, the control system (not shown) may dynamically balance the proportions of fuel delivered as liquid and delivered as vapor in view of the desired heat transfer. In operation, mass flow rates of the pilot fuel relative to the total may be small (e.g., less than 10% for the pilot fuel at subsonic cruise conditions). The high pressure compressor experiences high temperatures generated at high flight Mach numbers. Thus, greater cruise heat transfer will be required at supersonic conditions, biasing a desirable balance toward vapor at such speeds. The system may be sized such that the main liquid fuel flow reaches a capacity limit at an intermediate power. Thus at higher power non-cruise conditions (e.g., up to max. power), both heat transfer and high total fuel requirements may indicate substantial use of the vaporized fuel in addition to a maximal flow of liquid fuel, thus also biasing toward vapor (at least relative to a low or zero vapor flow at low subsonic cruise conditions).

In one example, at maximum dry power operation the vapor system could be employed at Mach numbers greater than 0.5, whereas at cruise or part power operation the vapor system could be employed at Mach numbers greater than 1.0. The mass flow rate of fuel delivered along the third flow path may be 40-70% of a total main burner (e.g., exclusive of augmentor) fuel flow at an exemplary supersonic cruise condition, 30-50% at an exemplary subsonic cruise condition, 40-70% at an exemplary subsonic max power condition, and 60-80% at an exemplary supersonic max. power condition. A ratio of the effective cross-sectional areas of the second and third passageways may be between 1:2 and 1:4.

One or more embodiments of the present invention have been described. Nevertheless, it will be understood that various modifications may be made without departing from the spirit and scope of the invention. For example, the invention may be applied to a variety of existing or other combustion system configurations. The details of such underlying configurations may influence details of any particular implementation. Accordingly, other embodiments are within the scope of the following claims.

What is claimed is:

1. A method for fueling an engine associated with a source of fuel in liquid form, the method comprising:

piloting the engine with a pilot flow of the fuel delivered to a combustor as a liquid;

delivering a first additional flow of the fuel to the combustor as a liquid;

vaporizing a second additional flow by drawing heat from at least one system on or associated with the engine, the vaporizing comprising passing the second additional flow through an air-to-fuel heat exchanger; and delivering the second additional flow of the fuel to the combustor as vapor.

2. The method of claim 1 wherein:

in at least certain conditions, the first and second additional flows are simultaneous.

3. The method of claim 1 wherein:

the first and second additional flows are simultaneous and a mass flow of the second additional flow is 40-70% of a total main burner fuel flow.

4. The method of claim 1 further comprising:

dynamically balancing a ratio of the first additional flow to the second additional flow based upon a combination of a desired heat extraction from the at least one system and a desired total fuel flow for the engine.

5. The method of claim 1 wherein:

the engine is on an aircraft and produces thrust.

6. The method of claim 1 wherein:

the engine is a gas turbine engine.

7. The method of claim 1 further comprising:

operating the engine so that the second additional flow represents an increasing portion of a total fuel flow with increasing engine power over at least a first range.

8. The method of claim 1 further comprising:

operating the engine so that the first additional flow essentially reaches a maximum rate at a first engine power and the second additional flow represents an increasing portion of a total fuel flow with increasing engine power above said first power.

9. The method of claim 1 wherein the pilot flow, first additional flow, and second additional flows are delivered through an injector having:

a mounting flange;

a stem extending from a proximal portion at the mounting flange to a distal portion;

a nozzle proximate the stem distal portion;

a first passageway through the stem and extending from a first inlet to a first outlet at the nozzle, the first outlet comprising a first plurality of apertures discharging the second additional flow;

a second passageway through the stem and extending from a second inlet to a second outlet at the nozzle, the second outlet comprising a second plurality of apertures, generally inboard of the first plurality of apertures and discharging the first additional flow; and a third passageway through the stem and extending from a third inlet to a third outlet at the nozzle, the third outlet comprising at least one third aperture, generally inboard of the first plurality of apertures and discharging the pilot flow.

10. The method of claim 9 wherein:

the first passageway has an effective cross-sectional area larger than an effective cross-sectional area of the second passageway; and the effective cross-sectional area of the first passageway is larger than an effective cross-sectional area of the third passageway.

11. The method of claim 9 wherein:

along major portions of respective lengths, the first, second, and third passageways are within respective first, second and third conduits.

12. The method of claim 11 wherein:

the first passageway includes an outlet plenum.

13. The method of claim 1 wherein the pilot flow, first additional flow, and second additional flows are delivered through an injector having:

a stem extending from a proximal portion at the mounting flange to a distal portion;

a nozzle proximate the stem distal portion;

a first passageway through the stem and extending from a first inlet to a first outlet at the nozzle and carrying the second additional flow;

a second passageway through the stem and extending from a second inlet to a second outlet at the nozzle and carrying the first additional flow; and a third passageway through the stem and extending from a third inlet to a third outlet at the nozzle and carrying the pilot flow.

14. A method for fueling an engine associated with a source of fuel in liquid form, the method comprising:

piloting the engine with a pilot flow of the fuel delivered to a combustor as a liquid;

delivering a first additional flow of the fuel to the combustor as a liquid;

vaporizing a second additional flow by drawing heat from at least one system on or associated with the engine; and delivering the second additional flow of the fuel to the combustor as vapor; and dynamically balancing a ratio of the first additional flow to the second additional flow based upon a combination of a desired heat extraction from the at least one system and a desired total fuel flow for the engine.

15. A method for fueling an engine associated with a source of fuel in liquid form, the method comprising:

piloting the engine with a pilot flow of the fuel delivered to a combustor as a liquid;

delivering a first additional flow of the fuel to the combustor as a liquid;

delivering a second additional flow of the fuel to the combustor as vapor; and operating the engine so that the second additional flow represents an increasing portion of a total fuel flow with increasing engine power over at least a first range.

16. A method for fueling an engine associated with a source of fuel in liquid form, the method comprising:

piloting the engine with a pilot flow of the fuel delivered to a combustor as a liquid;

delivering a first additional flow of the fuel to the combustor as a liquid;

delivering a second additional flow of the fuel to the combustor as vapor; and operating the engine so that the first additional flow essentially reaches a maximum rate at a first engine power and the second additional flow represents an increasing portion of a total fuel flow with in creasing engine power above said first power.

17. A method for fueling an engine associated with a source of fuel in liquid form, the method comprising:

piloting the engine with a pilot flow of the fuel delivered to a combustor as a liquid;

delivering a first additional flow of the fuel to the combustor as a liquid; and delivering a second additional flow of the fuel to the combustor as vapor, wherein the pilot flow, first additional flow, and second additional flows are delivered through an injector having:

a mounting flange;

a stem extending from a proximal portion at the mounting flange to a distal portion;

a nozzle proximate the stem distal portion;

a first passageway through the stem and extending from a first inlet to a first outlet at the nozzle, the first outlet comprising a first plurality of apertures discharging the second additional flow;

a second passageway through the stem and extending from a second inlet to a second outlet at the nozzle, the second outlet comprising a second plurality of apertures, generally inboard of the first plurality of apertures and discharging the first additional flow; and a third passageway through the stem and extending from a third inlet to a third outlet at the nozzle, the third outlet comprising at least one third aperture, generally inboard of the first plurality of apertures and discharging the pilot flow.

18. The method of claim 17 wherein:

the first passageway has an effective cross-sectional area larger than an effective cross-sectional area of the second passageway; and the effective cross-sectional area of the first passageway is larger than an effective cross-sectional area of the third passageway.

19. The method of claim 17 wherein:

along major portions of respective lengths, the first, second, and third passageways are within respective first, second and third conduits.

20. The method of claim 19 wherein:

the first passageway includes an outlet plenum.

21. A method for fueling an engine associated with a source of fuel in liquid form, the method comprising:

piloting the engine with a pilot flow of the fuel delivered to a combustor as a liquid;

delivering a first additional flow of the fuel to the combustor as a liquid; and delivering a second additional flow of the fuel to the combustor as vapor, wherein the pilot flow, first additional flow, and second additional flows are delivered through an injector having:

a stem extending from a proximal portion at the mounting flange to a distal portion;

a nozzle proximate the stem distal portion;

a first passageway through the stem and extending from a first inlet to a first outlet at the nozzle and carrying the second additional flow;

a second passageway through the stem and extending from a second inlet to a second outlet at the nozzle and carrying the first additional flow; and a third passageway through the stem and extending from a third inlet to a third outlet at the nozzle and carrying the pilot flow.

* * * * *

UNITED STATES PATENT AND TRADEMARK OFFICE

CERTIFICATE OF CORRECTION

PATENT NO. : 7,337,614 B2
APPLICATION NO. : 11/184264
DATED : March 4, 2008
INVENTOR(S) : Curtis C. Cowan It is certified that error appears in the above-identified patent and that said Letters Patent is hereby corrected as shown below:

In column 7, line 4, “in creasing” should read --increasing--.

Signed and Sealed this

Eighth Day of July, 2008

JON W. DUDAS
*Director of the United States Patent and Trademark Office*